US005640952A

United States Patent [19]

Swann et al.

[11] Patent Number: 5,640,952

[45] Date of Patent: Jun. 24, 1997

[54] PERSONAL EMERGENCY BREATHING SYSTEM FOR SUPPLIED AIR RESPIRATORS

[76] Inventors: Linsey J. Swann, 3325, West 3rd Avenue, Vancouver, B.C., Canada, V6R 1L3; Donald A. McLean, 4486 West 6th Avenue, Vancouver, B.C., Canada, V6R 1V3

[21] Appl. No.: 522,588

[22] Filed: Sep. 1, 1995

[51] Int. Cl.[6] ..... A62B 7/00

[52] U.S. Cl. ..... 128/206.17; 128/205.27; 128/205.23; 128/205.16; 128/204.27

[58] Field of Search ..... 128/204.18, 204.27, 128/205.12, 205.15, 205.16, 205.23, 205.27, 206.17, 205.25, 202.27, 206.16; 55/DIG. 33, DIG. 35

[56] References Cited

U.S. PATENT DOCUMENTS

| | | | |
|---|---|---|---|
| 3,867,936 | 2/1975 | Kelley | 128/205.12 |
| 4,038,057 | 7/1977 | Roth | 55/270 |
| 4,111,197 | 9/1978 | Warncke et al. | 128/202.27 |
| 4,793,342 | 12/1988 | Haber et al. | 128/202.27 |
| 4,850,346 | 7/1989 | Michel et al. | 128/206.17 |
| 4,997,217 | 3/1991 | Kunze | 128/202.27 |
| 5,036,844 | 8/1991 | Pouchot et al. | 128/206.17 |
| 5,222,488 | 6/1993 | Forsgren | 128/206.17 |
| 5,224,474 | 7/1993 | Bloomfield | 128/206.17 |
| 5,315,987 | 5/1994 | Swann | 128/201.28 |
| 5,318,019 | 6/1994 | Celaya | 128/205.12 |
| 5,513,626 | 5/1996 | Hamilton | 128/202.27 |
| 5,524,616 | 6/1996 | Smith et al. | 128/205.27 |

*Primary Examiner*—Vincent Millin
*Assistant Examiner*—V. Srivastava
*Attorney, Agent, or Firm*—Nixon & Vanderhye

[57] ABSTRACT

The personal emergency breathing system includes a canister with a filtration unit for supplying filtered ambient air to a gas mask. The mask includes a fitting from which a regulator and hose coupled to an air tank may be removed after exhaustion of the supply of air and to which the canister is coupled to supply filtered ambient air to the user. Upon removal of the canister from the mask, the canister affords an indication of prior use of the canister and is simultaneously disabled from resecurement to the gas mask.

21 Claims, 7 Drawing Sheets

PERSONAL EMERGENCY BREATHING SYSTEM FOR SUPPLIED AIR RESPIRATORS

TECHNICAL FIELD

The present invention relates to an emergency personal breathing system for use with supplied air respirators of the type having a face mask and an air supply for supplying respiratory air to the user and particularly relates to a canister containing filter material for application to the face mask and supplying filtered ambient air to the user in the event the supply of respiratory air is exhausted or cannot otherwise be supplied to the user

BACKGROUND

Personal emergency breathing systems have been proposed in the past and are now commercially available. One such system is described and illustrated in U.S. Pat. No. 5,315,987, the disclosure of which is incorporated herein by reference. Generally, in that system, a canister contains a protective hood, a multi-stage air purifying chemical filter attached to the hood and a valved mouthpiece complete with attached nose clip within the hood, all sealed within the canister until opened for use. When opened, the hood is drawn about an individual's head and neck, and ambient air is drawn into and through the filter with inhalation being effected through the mouthpiece. Exhaled air passes into the hood and outwardly between the individual's neck and the margin of the hood opening drawn about the neck. The multi-stage filter is designed to filter toxic gases, convert carbon monoxide to carbon dioxide and, as an alternative, oxygen, and provide filtered, breathable air for life support for a specified period of time, for example, in excess of ten minutes. This system has been found eminently useful for situations of one-time emergency use. For example, canisters of this type may be located in individual houses or apartment buildings for use by home owners or tenants in the event of a fire. In situations of that type, each user will typically open the canister, don the hood and breath filtered ambient air as he or she exits the house or building. Such system, however, is not designed for professional use, for example, by firefighters. Typically, firefighters will employ a supplied air respirator system comprised of a mask, usually a full-face mask, having a regulator and a hose connection to an air supply, for example, a tank carried on the back of the firefighter. When the firefighter dons the face mask and the system is operational, air is supplied from the tank to the firefighter via the hose, regulator and mask. The supply of respiratory air is, of course, limited. Should the professional, e.g., firefighter, use the entirety of the air supply or should the system malfunction while such professional remains in a hazardous area, i.e., an area having high concentrations of contaminants, smoke and the like, there can be great danger to life or health. A need, therefore, has arisen for a breathing system supplemental to a supplied air respiratory system for supplying breathable filtered air to the user in the event the air supply is exhausted or the latter system malfunctions.

DISCLOSURE OF THE INVENTION

In accordance with the present invention, there is provided a personal emergency breathing system for use with a supplied air respirator of the type employing a face mask coupled to a supply of air, e.g., an air tank, wherein, should the air supply become exhausted or the system malfunction, a canister containing filter material can be immediately coupled to the mask enabling the user to breathe filtered ambient air for a limited period of time. Thus, professional or emergency personnel, e.g., a firefighter, are provided breathable air for a time sufficient for them to leave a hazardous area in the event the supplied air is exhausted or the respirator malfunctions. Additionally, the present invention provides a canister of filter material for one-time use wherein the connection and disconnection between the canister and face mask automatically provide an indication that the canister has been used and preclude reconnection or resecurement of the canister to the gas mask after such one-time use, hence preventing multiple use of the canister.

To accomplish the foregoing, the present invention provides a canister comprised of a body housing a filtration unit or stage containing filter material, the housing being closed at one end by a closure or cover. The filter material may be disposed in layered form within the canister body and preferably comprises a layer each of activated charcoal granules, a desiccant and a catalyst for catalyzation of carbon monoxide to carbon dioxide, each layer being separated by an electrically charged fabric filter for collecting particulate matter. Preferably, the filter material is in the form of a catalytic monolithic filter. Also, a layer of lithium peroxide or other suitable chemical may comprise a fourth layer of filter material for converting carbon dioxide to oxygen. With the removal of the cover or a closure for the canister, the open canister receives ambient air for passage through the filter unit whereby filtered air may be provided a user as outlined below. In an alternate form, the inlet to the canister may be provided through an aperture normally sealed by a plastic air-tight push-fit seal or a removable adhesive metallic foil. In any case, the air inlet to the canister and filtering material is normally closed when the system is not in use. The canister also has a collar at one end compatible for quick connection to a fitting on the gas mask. While the fitting may be specially designed for use with the canister and comprise a fitting in addition to the fitting required for connecting the air supply, i.e., the air tank, to the gas mask, it is preferable that the same fitting for supplying air to the user from the air tank, is also used to supply filtered ambient air through the canister to the user in the event the air supply tank is exhausted or the respiratory system malfunctions. Thus, in the event of a malfunction or exhaustion of the air supply of the supplied air respiratory system, the user quickly disconnects the regulator and attached hose from the air supply, removes the canister cover and couples the canister to the fitting of the gas mask whereby the user is supplied breathable ambient air through the canister for a limited period of time. It is also a feature of the present invention that, upon removal of the canister from the gas mask after use, an indicator readily indicates that the canister has been used. Additionally, the canister is rendered incapable of resecurement to the gas mask after such one-time use.

To accomplish the foregoing and in one embodiment hereof, the collar includes an annular sleeve receivable within the annular quick connect/disconnect of the fitting on the gas mask such that, upon removal of the closure or cover for the canister, the sleeve may be applied to the fitting to connect the canister to the mask. Thus, the canister may be applied directly to the mask or to the bottom of the delivery hose from the regulator sometimes mounted on the belt. The collar of the canister includes a catch which is preferably movable in an axial direction of the canister between a first position enabling securement between the collar and the fitting and a second position, responsive to release of the canister from the fitting, precluding resecurement of the collar and, hence, the canister to the gas mask or hose. The catch includes a bifurcated lower end having flanges or projections for releasably retaining the catch in the first position. The bifurcated legs of the catch also have locking surfaces which engage with complementary locking surfaces on the collar when the catch is moved to the second position to prevent returning movement of the catch to the first position. Along a surface of the catch, there is provided a projection for engagement by the fitting upon connection of the canister to the gas mask or fitting. Consequently, when the canister collar is withdrawn from the fitting of the gas mask, the fitting displaces the catch from the first position to the second position. This moves the locking surfaces of the catch and collar into engagement one with the other, locking the catch in the second position, preventing return of the catch to the first position. In the second position, the catch projects from the collar sufficiently to visually indicate that the canister has been used and prevents resecurement of the collar to the fitting of the gas mask.

In another embodiment of the present invention, the mask of the supplied air respiratory system has a threaded fitting for securement to the regulator of the standard air supply. When the regulator is unthreaded from the fitting upon malfunction or exhaustion of the air supply from the tank, the canister may be threadedly disposed on the fitting to supply filtered ambient air to the user. In this form, the collar includes a pivoted catch on one side of the collar and a movable retaining member or ring. The ring is normally retained before use in a position such that threads on the movable member are aligned with threads on the collar whereby the canister collar may be threadedly engaged with the complementary threads on the fitting. When the canister is being secured to the fitting, the threading action causes the retaining ring to be axially displaced to the opposite side of the pivot axis of the pivotal member, biasing the member for movement. Because of the threaded connection between the fitting and the collar, however, the pivotal member remains threaded to the fitting but is under a biasing force from the retaining ring. Upon unthreading and removal of the canister from the gas mask, this forceful bias applied to the pivoted member by the ring pivots the threaded portion of the pivoted catch away from alignment with the threads about the collar, affording a visual indication that the canister has been used and precluding threaded reattachment of the canister to the gas mask.

In both forms of the present invention, it will be appreciated that the canister is intended to supply filtered ambient air to the user of the self-contained respiratory system in the event the latter malfunctions or the supply of air is exhausted. For example, should a firefighter remain in a hazardous area after his supply of air is exhausted, he may remove the regulator and hose from his tank and immediately secure the canister to the gas mask. In this manner, the firefighter will be able to breathe filtered ambient air for a limited period of time sufficient to remove himself from the hazardous area.

In a preferred embodiment according to the present invention, there is provided a personal emergency breathing system, comprising a gas mask for overlying a user's face and having a fitting for supplying respiratory air to a user, a canister having an opening and a closure removably carried by the canister for closing the opening, the canister including an air passage in communication with the opening for receiving ambient air upon removal of the closure, an air filtration unit containing air filtering material within the canister for filtering ambient air received through the opening and the air passage when the closure is removed and passing through the filtering material and a collar carried by the canister and defining a filtered air outlet passage in communication with the air filtration unit for receiving filtered air therefrom, the collar and the fitting being releasably secured to one another for releasably securing the canister to the gas mask whereby filtered air may be transmitted from the canister into the gas mask.

In a further preferred embodiment of the present invention, there is provided a personal emergency breathing system for attachment to a gas mask, comprising a canister having an opening and a closure removably carried by the canister for closing the opening, the canister including an air passage in communication with the opening for receiving ambient air upon removal of the closure, an air filtration unit containing air filtering material within the canister for filtering ambient air received through the opening and the air passage when the closure is removed and passing through the filtering material, a collar carried by the canister and defining a filtered air outlet passage in communication with the air filtration unit for receiving filtered air therefrom, the collar being adapted for releasable securement to a fitting on the gas mask for releasably securing the canister to the gas mask whereby filtered air may be transmitted from the canister into the gas mask and a catch carried by the canister and movable between a first position enabling securement between the collar and the fitting and a second position, upon release of the canister and gas mask, precluding resecurement of the collar and the fitting, the catch having a locking surface engageable with a locking surface carried by the collar in the second position of the catch for preventing the catch from moving from the second position into the first position, whereby subsequent reuse of the air filtration canister with the gas mask is prevented by precluding resecurement of the collar and the fitting.

In a still further preferred embodiment according to the present invention, there is provided a personal emergency breathing system for attachment to a gas mask, comprising a canister having an opening and a closure removably carried by the canister for closing the opening, the canister including an air passage in communication with the opening for receiving ambient air upon removal of the closure, an air filtration unit containing air filtering material within the canister for filtering ambient air received through the opening and the air passage when the closure is removed and passing through the filtering material, a collar carried by the canister and defining a filtered air outlet passage in communication with the air filtration unit for receiving filtered air therefrom, the collar being adapted for releasable securement to a fitting on the gas mask for releasably securing the canister to the gas mask whereby filtered air may be transmitted from the canister into the gas mask, a catch carried by the canister and pivotal between a first position enabling securement between the collar and the fitting and a second position, after release of the canister and gas mask, precluding resecurement of the collar and the fitting and a movable member carried by the collar for retaining the pivoted catch in the second position.

Accordingly, it is a primary object of the present invention to provide a novel and improved personal emergency breathing system for providing filtered ambient air as a supplement to a supplied air respiratory system when the latter fails or its supply of air is exhausted.

BEST MODE FOR CARRYING OUT THE INVENTION

Figure 1A:
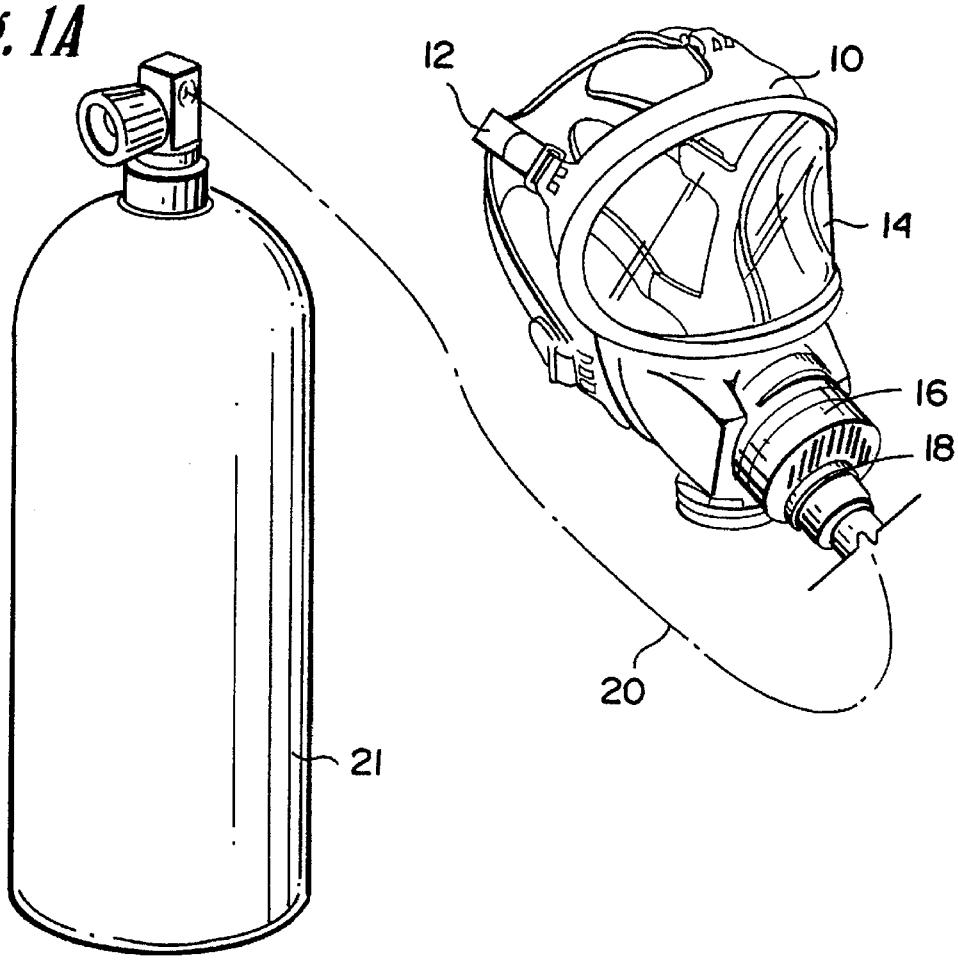
FIG. 1A is a schematic perspective view of a supplied air respiratory system including a gas mask coupled to an air tank.
Figure 1B:
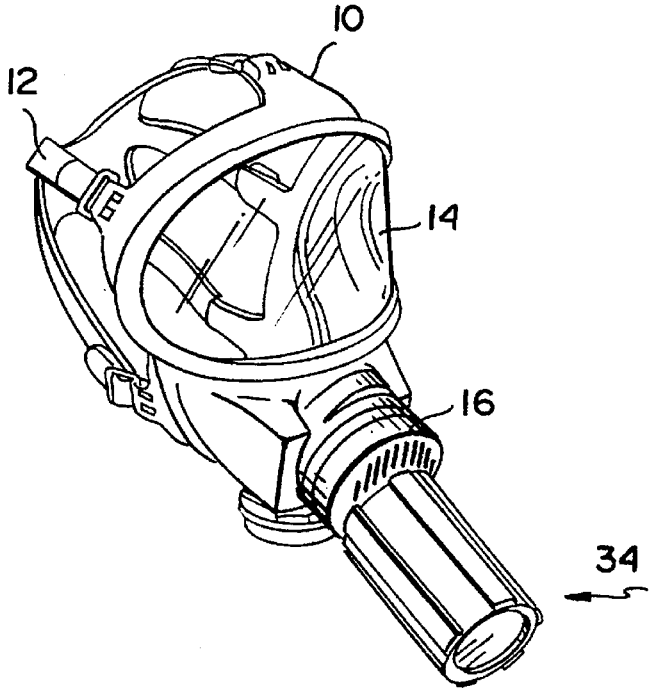
FIG. 1B is a similar view of the gas mask illustrating a canister coupled to the gas mask for supplying filtered ambient air to the user in accordance with the present invention.
Figure 3C:
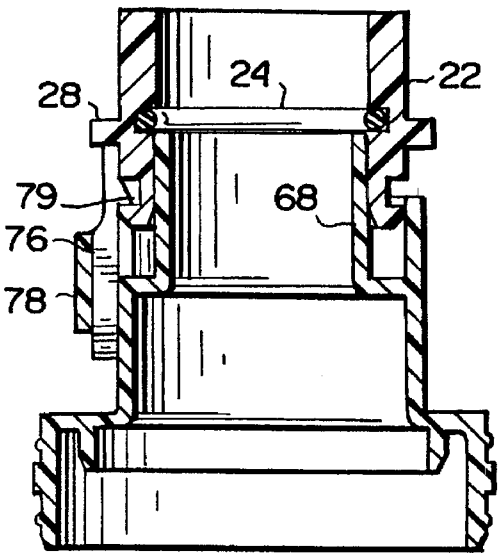
FIGS. 3A, 3B and 3C are cross-sectional views illustrating the manner of attachment and release of the gas mask fitting and canister collar in a first embodiment hereof.
Figure 3B:
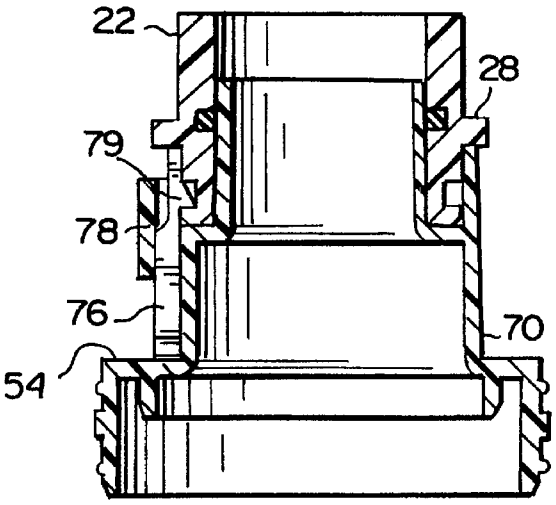
Figure 3A:
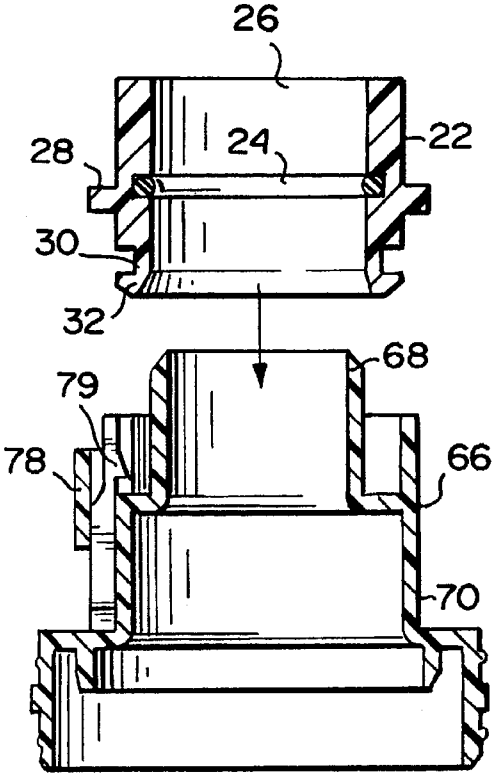

Referring now to FIGS. 1A and 1B, there is illustrated a typical supplied air respiratory system including a gas mask 10 having straps 12 for releasably securing the mask 10 to a user, a face plate 14 and a valve mechanism 16 including a fitting 18 for releasably securing the regulator of an air supply system coupled to a hose 20 for supplying air from a tank 21 to the face mask. The face mask, regulator and air supply tank are conventional in construction. It will be appreciated that the gas mask fitting 18 may be one of two conventional types. In a first type, the fitting is provided with a quick connect/disconnect for coupling the regulator and hose to the mask 10. One form of this quick connect/disconnect fitting is illustrated in FIGS. 3A–3C and includes a sleeve 22, having an O-ring seal 24 disposed in a groove within the passage 26 of the fitting, an outwardly directed flange 28 and a radially outwardly opening groove 30 forming a flange 32 at the end of the fitting. Another form of fitting for the gas mask will be described hereafter in conjunction with the second embodiment of the present invention illustrated in FIGS. 5–7.

Figure 1C:
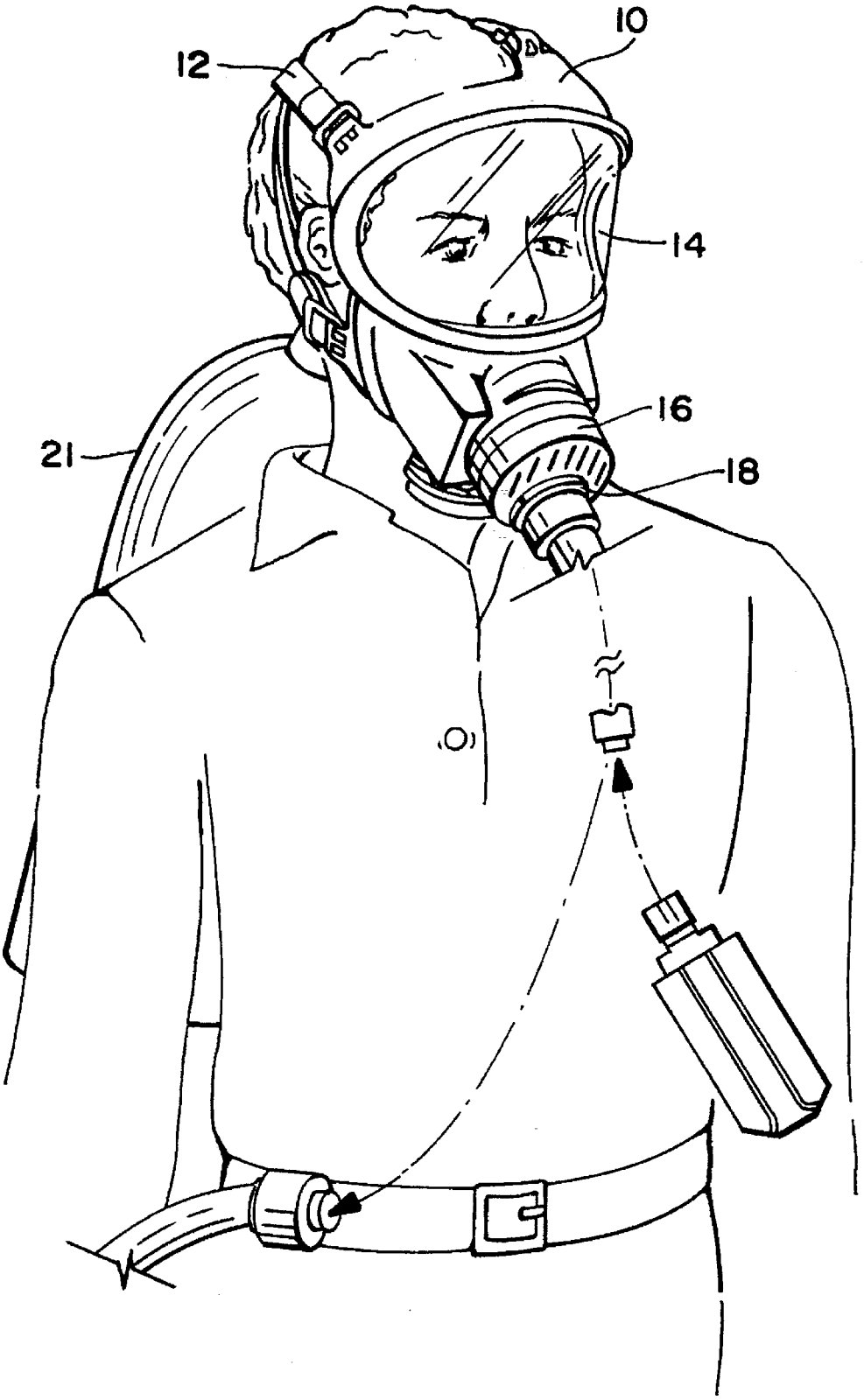
FIG. 1C is a similar view illustrating the canister coupled to a delivery hose from the regulator.
Figure 2:
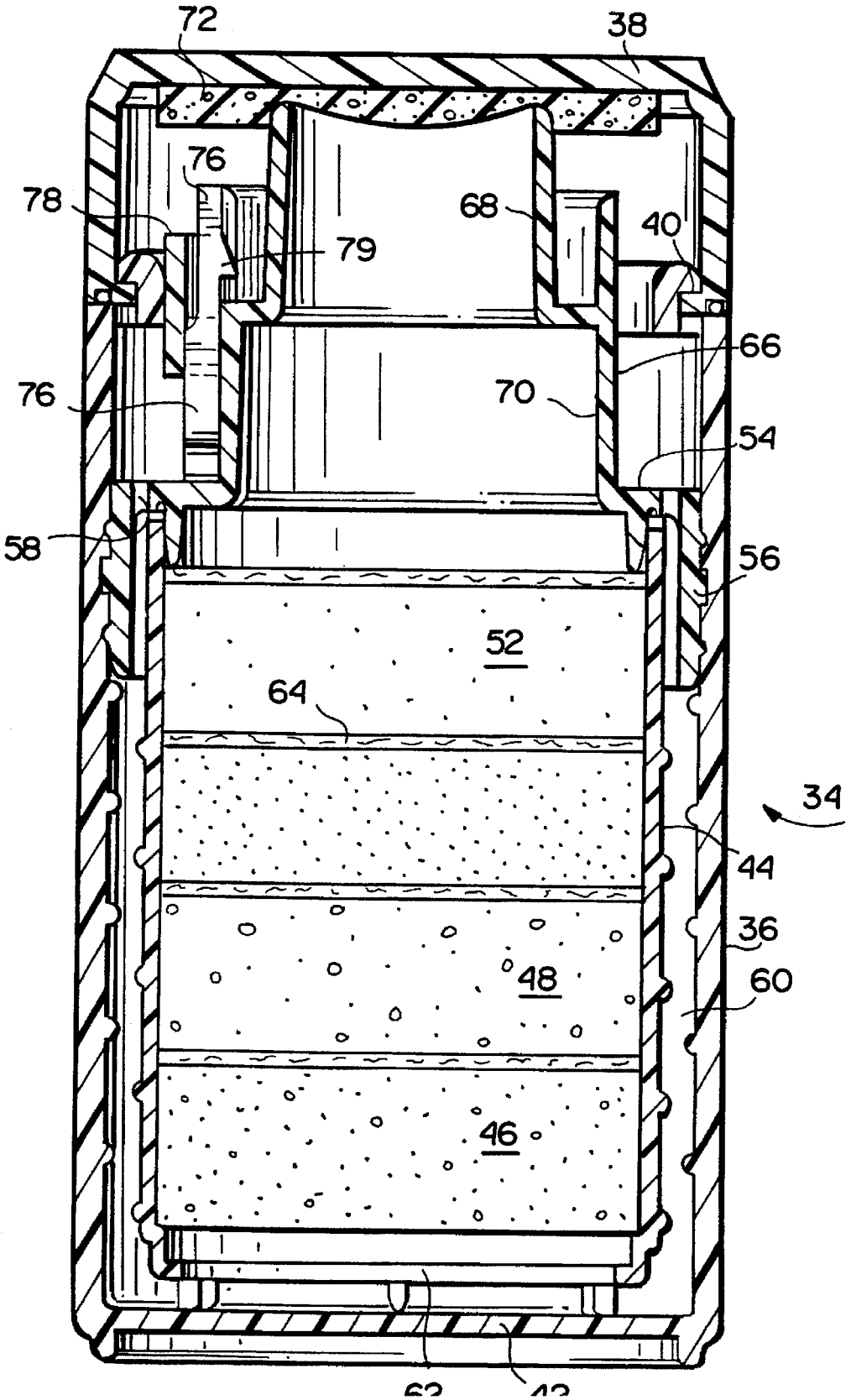
FIG. 2 is an enlarged cross-sectional view of the canister in a closed condition.

Referring now to FIG. 2, there is illustrated a canister constructed in accordance with the present invention for releasable coupling to the fitting of the gas mask upon disconnection of the regulator and air hose from the mask to supply filtered ambient air to the user. The canister, generally designated 34, is supplied in a closed configuration for carrying by the user of the supplied air respiratory system, for example, on a belt carrying the user's equipment. Consequently, when the user's air supply, for example, from tank 21, is exhausted or the system malfunctions, canister 34 is removed from the belt, the regulator and hose are disconnected from the gas mask and the canister is connected to the gas mask to supply filtered ambient air. Alternatively, as illustrated in FIG. 1C, the delivery hose H may have a quick connect/disconnect bottom fitting 22 for connection to a regulator sometimes carried on a belt, the regulator forming part of an air supply conduit to the gas mask. Thus, fitting 22 may be disconnected from the regulator and the canister connected to the fitting 22 to supply filtered air to the gas mask through the delivery hose.

More particularly and referring to FIG. 2, canister 34 includes a housing or body 36 having a cover 38 releasably secured to the housing 36, for example, by a bayonet-type joint 40. In a preferred form hereof, the canister housing 36 is closed at its bottom end 42. Disposed within the housing 36 is a filtration unit 44 containing filter material. For example, the filter unit comprises an annular sleeve or housing encompassing layers of air filtering material. Particularly, the filtering materials may be arranged in stages, the first stage 46 comprising activated carbon granules, e.g., Calgon-type ASC Grade III activated carbon granules (12×20 mesh); the second stage 48 comprising a desiccant to remove moisture from the inhaled ambient air, e.g., a zeolite-type Z 3-01/3A (8×12 mesh 1–2 mm); a third stage 50 for converting carbon monoxide to carbon dioxide by a catalyzation process, for example, a carulite-type 200, a copper manganese oxide hopkalite catalyst; and a fourth, optional, stage 52 for converting carbon dioxide to oxygen, e.g., lithium peroxide or other suitable chemicals, preferably a monolithic filter for converting carbon monoxide to carbon dioxide. Use of a monolithic filter will eliminate the need for the use of zeolite as a prefilter but will still retain the use of activated carbon.

The filtration unit housing 44 is seated in an annular ring 54 having a depending flange 56 which is threadedly secured to the inside of housing 36, securing the filtration unit within the canister. As illustrated in FIG. 2, a plurality of openings 58 are provided through the ring 54 for supplying ambient air, when cover 38 is removed, into the annular space 60 between housings 44 and 36 for flow into the open lower end 62 of the filtration unit housing 44. Thus, when the canister is open, ambient air flows through the open end of the canister, openings 58, and the annular passageway 60 and into and through the filtration layers. The layers may be separated from one another by electrostatically charged fiber filters 64 for collecting and absorbing particulate matter, for example, minute particles of smoke. The filter may also comprise a pleated P3 type particulate filter.

The ring 54 includes a collar 66 having inner and outer sleeves 68 and 70, respectively. As illustrated, the inner sleeve 68 projects upwardly beyond the upper end of outer sleeve 70. The underside of the closure or cover 38 carries a seal, for example, a closed-cell foam material 72 which seals about the end of inner sleeve 68 when the cover is applied to the canister housing 36, thus completely sealing the interior of the housing and particularly the filtration unit 34. Preferably and alternatively, an O-ring seal may be provided along the margin of the cap as indicated at 73 whereby the material 72 may be omitted or retained as a secondary seal.

Figure 4A:
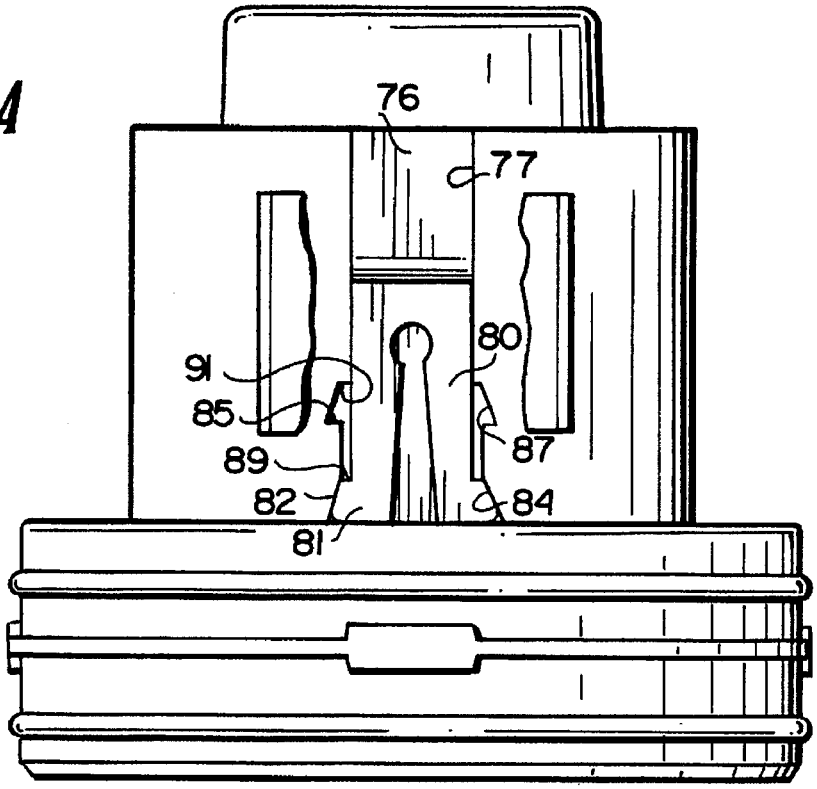
FIGS. 4A and 4B are enlarged side elevational views of the collar with portions broken out for clarity of illustration illustrating the catch in first and second positions, respectively.
Figure 4B:
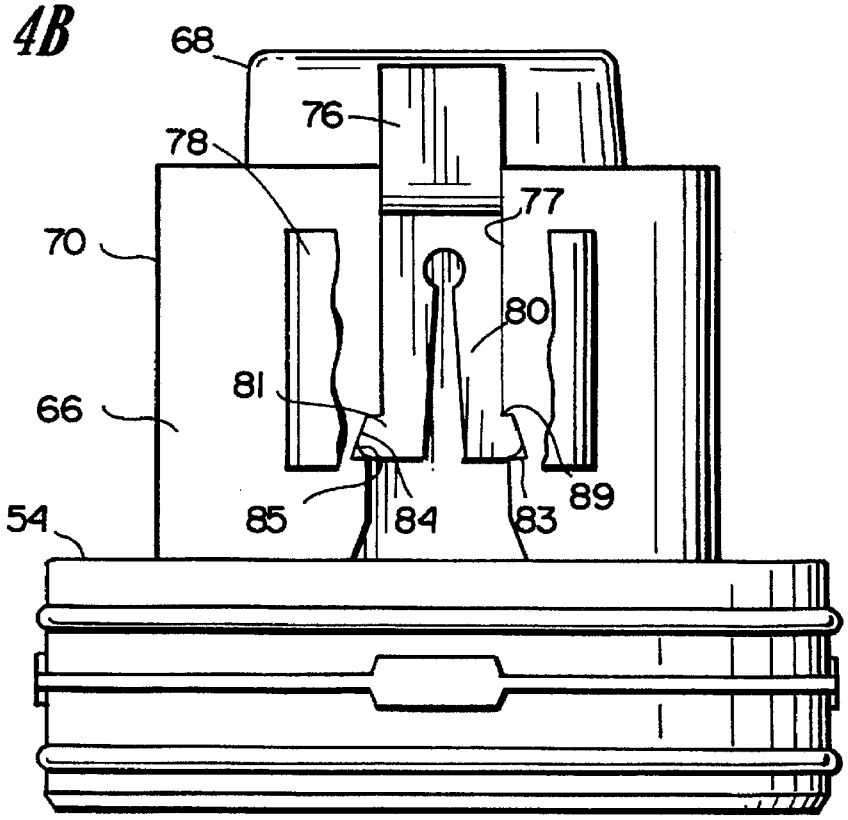

The collar 66 includes a catch 76 slidably disposed in a slot 77 formed between the outer sleeve and an overlying member 78 formed integrally or secured to collar 66. As best illustrated in FIGS. 4A and 4B, the lower end of catch 76 is bifurcated to form a pair of legs 80 each terminating at their lower distal ends in flanges 81 having inclined outer surfaces 82 which cooperate with complementary surfaces 84 formed in a first set of recesses along the opposite edges of and adjacent the base of slot 77 forming part of the outer sleeve 70. As illustrated in FIG. 4A, the catch 76 is thus located and retained in a first position with the complementary surfaces 82 and 84 cooperating to detent catch 76 from movement in a lengthwise or axial outwardly direction. As illustrated in FIGS. 2 and 3, the catch 76 includes a radially inwardly projecting tooth 79 for cooperation with the fitting 22, as described below.

The catch 76 is movable to a second position illustrated in FIG. 4B. In the second position of the catch 76, the lower flanges 81 of the legs 80 bear in a second set of recesses formed along the edges of slot 77 axially of the first set of recesses. Particularly, the lower edges 83 of flanges 81 bear against stops 85, the inclined edges 82 of the flanges 81 bear against complementary inclined surfaces 87 and upper flats 89 on flanges 81 bear against stops 91, the stops 85 and 91 and the inclined surfaces 87 being formed in the edges of slot 77. This configuration prevents reverse lengthwise movement of the catch 76 from the second position illustrated in FIG. 4B to the first position illustrated in FIG. 4A as well as in the opposite direction. The overlying surface 78 maintains the catch in slot 77.

Referring to FIGS. 3A–3C, when the user has disconnected the regulator and hose from the mask of the supplied air respiratory system, the canister may be readily connected to the fitting of the gas mask or delivery hose to provide ambient filtered breathable air for a limited period of time. The leading edge of the filter may be beveled to facilitate the connection between the filter and fitting. Thus, after disconnection, the closure 38 is removed from the canister 34, opening the filtration unit for receiving ambient air. In another form of the canister as disclosed in U.S. Pat. No. 5,315,987, the bottom of the canister is provided with a plurality of openings closed by an adhesively secured metallic foil. By using a pull tab, the openings may be uncovered to supply ambient air via an air passage in the bottom of the canister to the filtration unit. Alternatively, a plug coupled to the cap by a line or strap may be employed such that, upon removal of the cap and tensioning of the line or strap, the plug can be removed to admit ambient air into the canister. Preferably, however, the canister filtration unit is automatically supplied ambient air by removal only of closure 38, the removal of the closure 38 being necessary for attachment of the canister to the mask. The collar 66, particularly interior sleeve 68, is then telescopically disposed within fitting 22, thus placing the gas mask in communication with filtered ambient air drawn through the filtration unit. When the fitting 22 is telescopically received about the inner sleeve 68 as illustrated in FIG. 3B, it will be appreciated that the inner projection 79 of catch 76 engages in the groove 30 of fitting 22 behind flange 32. The projection 79 and legs 80 of the catch 76 in the first position of the catch in slot 77 thus maintain the canister and fitting coupled one to the other. After use, the canister may be disconnected from the fitting in a manner to indicate that the canister has been used and can no longer supply filtered air to a user and to prevent resecurement of the canister to the gas mask.

Referring to FIG. 3C, the canister is removed from the mask by displacing it axially away from the fitting. In doing so, the catch 76 is withdrawn or axially displaced outwardly by the engagement of projection 79 with flange 32. Consequently, the legs 80 are displaced inwardly toward one another as the catch is withdrawn and subsequently spring back to engage the flanges 81 in the second set of recesses formed in slot 77. Note that when the flanges engage in the second set of recesses, the catch 76 cannot be displaced further in an outward direction due to the engagement of stops 89 on flanges 81 against the stops 91 in the recesses, nor can it be displaced inwardly toward the first position because of the engagement of edges 83 against stops 85. Further displacement of the canister away from the fitting will cause the catch to momentarily flex in a radial outward direction, enabling complete detachment of the canister from the fitting of the gas mask. In that condition, as illustrated in FIG. 4B, the upper end of catch 76 projects beyond the upper end of outer sleeve 70, indicating to the user that the filter canister has been used. Preferably, the upper end of catch 76 may be color-coated, for example, colored in red to serve as a flag that the canister has been used. Additionally, with the projecting end located and locked axially outwardly of collar 66 in its second position, the canister cannot be resecured to the fitting of the gas mask because catch 76 will engage flange 28 of fitting 22 before the fitting can seat in collar 66.

Figure 5:
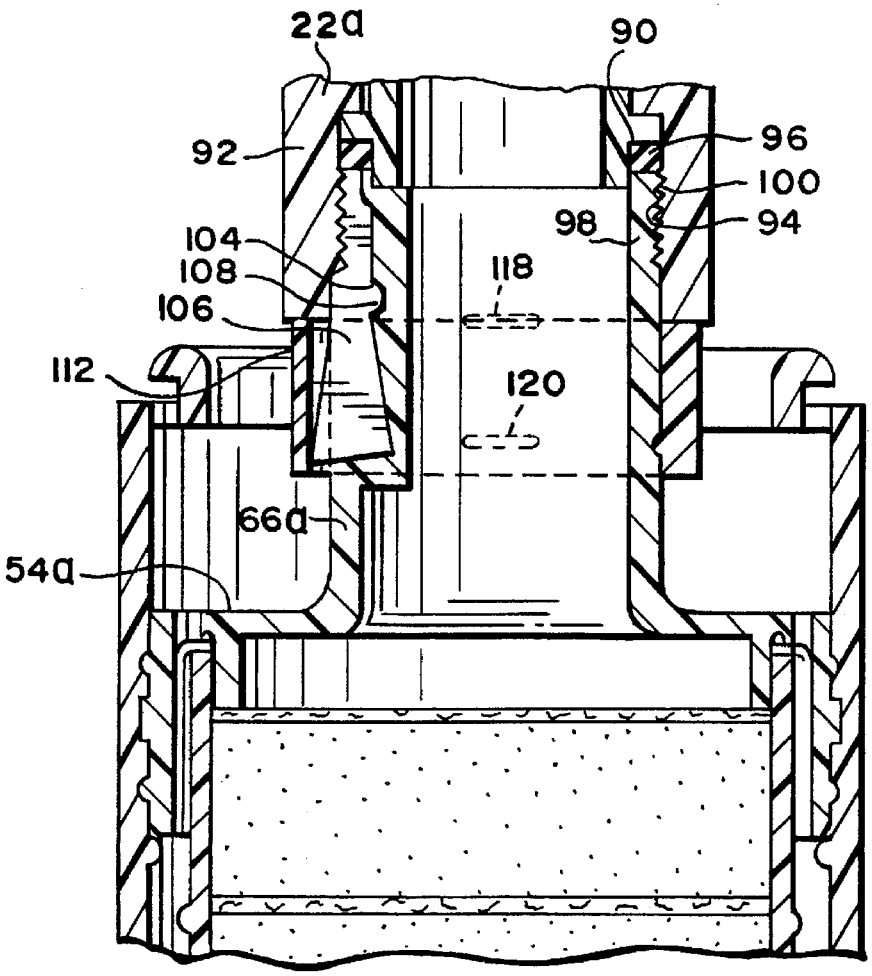
FIG. 5 is an enlarged cross-sectional view of the canister illustrating a further embodiment of a connection between the canister and fitting on the gas mask.
Figure 6:
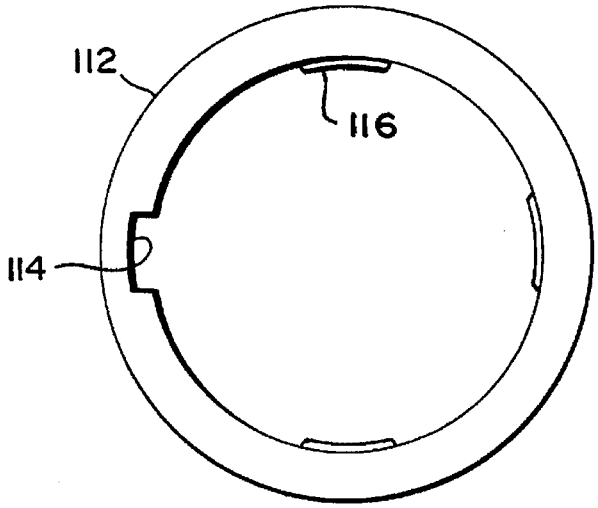
FIG. 6 is a plan view of a retaining ring employed in the connection illustrated in FIG. 5.

Referring now to FIGS. 5, 6 and 7, the canister may be adapted in a second embodiment of the present invention for use with a different type of fitting conventionally employed with gas masks. Referring to FIG. 5, the fitting **22*a* on the gas mask may comprise a sleeve 90 fixed to the gas mask and loosely rotatably carrying an outer coupling ring 92. Ring 92 is internally threaded at 94 and an O-ring seal 96 is secured to the sleeve 90**.

Figure 7A:
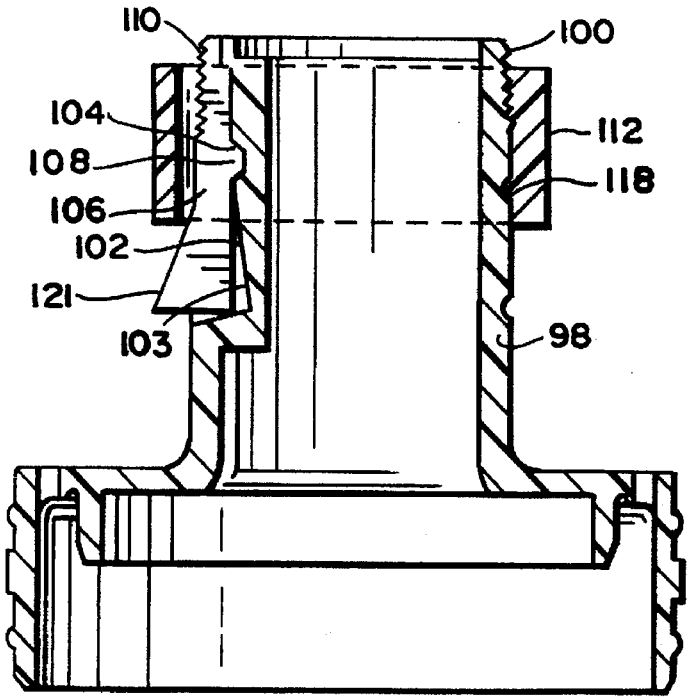
FIGS. 7A and 7B are cross-sectional views of the collar illustrating the position of the pivoted member before and after use of the canister.

To adapt the canister hereof to this type of connection, the ring **54*a* of the canister terminates in a collar 66*a* comprised of a single annular sleeve 98. Sleeve 98 is externally threaded at 100 for threaded connection with the internal threads carried by ring 92 after removal of the cover or closure for the canister, not shown in these drawing figures. The collar 66*a* includes a slot 102 extending axially along the outer surface thereof and having a groove 104. Disposed within the slot 102 is a pivotal member or catch 106 having a projection 108 bearing in the groove 106. The lower surface portion 103 of slot 102 registering with the interior face of catch 106 is inclined radially inwardly away from the registering interior faces of catch 106 whereby the catch 106 is pivoted about an axis formed between the groove 104 and projection 108 as illustrated upon comparing FIGS. 7A and 7B. Additionally, the upper end of catch 106 has an externally threaded surface 110 which, when in a first position illustrated in FIG. 7A, is aligned with the external threads 100 of the collar 98. When the catch 106 is pivoted into a second position illustrated in FIG. 7B, it will be appreciated that the threads 110 are pivoted out of alignment with the threads 100. An axially removable retaining ring 112 is disposed about collar 66*a*. Ring 112 includes a slotted portion 114 (FIG. 6) to receive outer portions of the catch 106. Ring 112, as illustrated in FIG. 6, has a plurality of circumferentially spaced, radially inwardly extending ribs 116 which engage in corresponding grooves 118 (FIG. 5) formed along the outer surface of sleeve 98 to retain ring 112 in a first position illustrated in FIG. 7A. The ribs 116, when the ring 112 is displaced to the second position illustrated in FIG. 7B, engage in a second set of correspondingly located grooves 120 to retain the ring 112 in the second position. Further, the outer surface 121 (FIG. 7A**) of the lower portion of the catch is outwardly inclined.

Figure 7B:
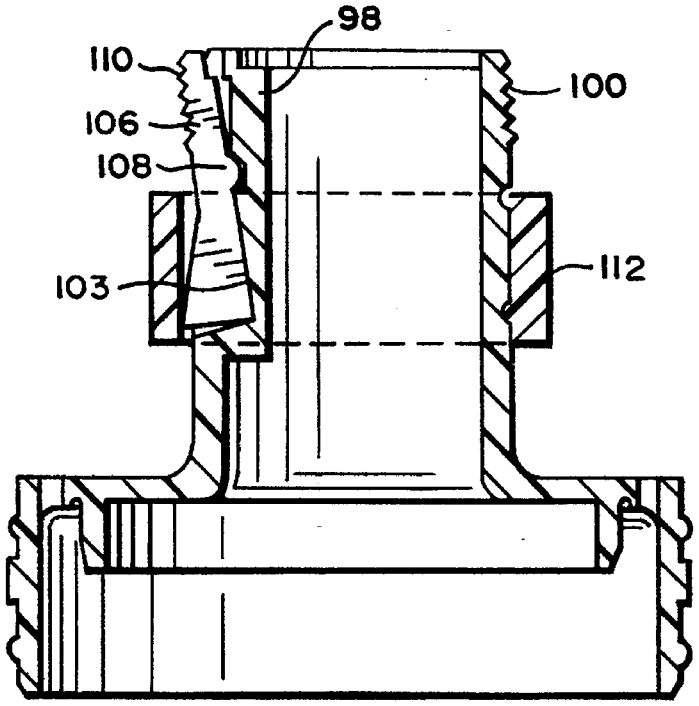

In use, and once the regulator and hose of the supplied air respiratory system have been unscrewed from the fitting of the gas mask, the canister illustrated in FIGS. 5–7 (after its cover has been removed) may be applied to the fitting by threading the coupling ring 92 about the external threads 100 and 110 of the collar **66*a* and catch 106, respectively. By threading ring 92 onto the sleeve 98 with the ring 112 in the first position, the threading action displaces the ring 112 toward the second position illustrated in FIG. 7B. In that second position, the ribs 116 engage in the grooves 120 to retain the ring in the second position. As illustrated in FIGS. 5, with the ring 112 in the second position, the inclined surface 121 of the catch 106 is engaged by ring 112 and causes the catch to resiliently flex, thereby biasing the catch for pivotal movement. However, because the upper threaded portion of the catch lies in threaded engagement with the coupling ring 92 of the fitting, only the lower portion of catch 106 flexes radially inwardly as seen in FIG. 5. In this configuration, the gas mask is in communication with the ambient filtered air drawn through the filtration unit thereby affording the user breathable air similarly as previously described with respect to the first embodiment hereof. When the user is no longer in the hazardous area, the canister may be removed from the gas mask by unthreading ring 92 relative to the threads 100 and 110 of collar 66***a* and catch 106, respectively. When the coupling ring 92 is completely unthreaded from the canister, the resilient bias afforded the catch by ring 112 in its second position enables the upper end of the catch 106 to flex radially outwardly of sleeve 98 as illustrated in FIG. 7B. Particularly, the threads 110 of the catch 106 project radially outwardly out of alignment with the threads 100 on the sleeve 98 affording a visual indication that the canister has been used. This also physically prevents resecurement of the canister to the gas mask, the ring 112 maintaining the catch 106 in the pivoted condition illustrated in FIG. 7B.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A personal emergency breathing system comprising:

a gas mask for overlying a user's face;

a respiratory air supply system for supplying respiratory air to a user and including a fitting;

a canister having an opening and a closure removably carried by said canister for closing said opening, said canister including an air passage in communication with said opening for receiving ambient air upon removal of said closure;

an air filtration unit containing air filtering material within said canister for filtering ambient air received through said opening, said air passage and said filtering material when said closure is removed;

a collar carried by said canister and defining a filtered air outlet passage in communication with said air filtration unit for receiving filtered air therefrom, said collar and said fitting being releasably secured to one another whereby filtered air may be transmitted from the canister through said collar and said filter air outlet passage into the gas mask; and an element carried by said canister and responsive to the securement or release of the canister and said mask relative to one another preventing re-securement of said canister and said mask relative to one another.

2. A breathing system according to claim 1 wherein said respiratory air supply system includes a breathable air supply comprised of a tank of air and a conduit for flowing air from said tank, said conduit and said fitting being releasably secured to one another for supplying breathable air from said tank to the user of the mask, said fitting, said collar and said conduit being configured such that only one of said collar and said conduit is releasably secured to said fitting at any one time during use whereby air is supplied to the mask from the respiratory supply system or through said air filtration unit but not simultaneously from both said respiratory supply system and said air filtration unit.

3. A breathing system according to claim 1 including an element carried by said canister and responsive to the securement or release of the canister and said fitting relative to one another for indicating prior use of said canister after the canister has been disconnected from the fitting.

4. A breathing system according to claim 1 wherein said respiratory air supply system includes a tank of air and a conduit for flowing air from said tank to the mask, the conduit and fitting being releasably secured to one another for supplying breathable air from said tank to the user of the mask, an element carried by said canister and responsive to the securement or release of the canister and said fitting relative to one another for indicating prior use of said canister after the canister has been disconnected from the fitting, said fitting, said collar and said conduit being configured such that only one of said collar and said conduit is releasably secured to said fitting at any one time during use whereby air is supplied to the mask from the respiratory supply system or through said air filtration unit but not simultaneously from both said respiratory supply system and said air filtration unit.

5. A breathing system according to claim 1 including a breathable air supply comprised of a tank of air and a flexible conduit for flowing air from said tank, and means for releasably securing the conduit and fitting to one another for supplying breathable air from said tank to the user of the mask, said fitting, said collar and said conduit being configured such that only one of said collar and said conduit is releasably secured to said fitting at any one time during use whereby air is supplied to the mask from the respiratory supply system or through said air filtration unit but not simultaneously from both said respiratory supply system and said air filtration unit.

6. A personal emergency breathing system for attachment to a gas mask, comprising:

a canister having an opening and a closure removably carried by said canister for closing said opening, said canister including an air passage in communication with said opening for receiving ambient air upon removal of said closure;

an air filtration unit containing air filtering material within said canister for filtering ambient air received through said opening, said air passage and said filtering material when said closure is removed;

a collar carried by said canister and defining a filtered air outlet passage in communication with said air filtration unit for receiving filtered air therefrom, said collar being adapted for releasable securement to a fitting on the gas mask for releasably securing the canister to the gas mask whereby filtered air may be transmitted from the canister through said collar and said filter air outlet passage into the gas mask; and a catch carried by said canister and movable between a first position enabling securement between said collar and the fitting and a second position, upon release of the canister and gas mask, precluding resecurement of the collar and the fitting;

said catch having a locking surface engageable with a locking surface carried by said collar in said second position of said catch for preventing said catch from moving from said second position into said first position, whereby subsequent reuse of the air filtration canister with the gas mask is prevented by precluding resecurement of the collar and the fitting.

7. A breathing system according to claim 6 including cooperating surfaces carried by said catch and said collar, respectively, for releasably retaining said catch in said first position thereof.

8. A breathing system according to claim 7 wherein said catch includes a pair of flexible legs, said cooperating surfaces having inclined surfaces on said legs and complementary inclined surfaces on said collar.

9. A breathing system according to claim 6 including a cover for said catch normally preventing access to the locking surfaces of said collar and said catch, respectively.

10. A breathing system according to claim 6 wherein said catch has a projection engageable by the fitting when said catch lies in said first position for following movement of the fitting upon release of the canister and gas mask from one another and moving the catch from said first position into said second position.

11. A breathing system according to claim 6 wherein said catch includes a pair of flexible legs having surfaces cooperable with complementary surfaces of said collar for releasably retaining said catch in said first position, said legs being flexible relative to one another to enable movement of said catch from said first position into said second position.

12. A breathing system according to claim 6 in combination with said gas mask having said fitting, said catch having a projection engageable by said fitting when said catch lies in said first position, said catch being movable into said second position in response to withdrawing movement of said collar and said fitting relative to one another, said fitting, said collar and said conduit being configured such that only one of said collar and said conduit is releasably secured to said fitting at any one time during use whereby air is supplied to the mask from the respiratory supply system or through said air filtration unit but not simultaneously from both said respiratory supply system and said air filtration unit.

13. A breathing system according to claim 6 in combination with a respiratory air supply system including said gas mask, said respiratory air supply system including a breathable air supply comprised of a tank of air and a conduit for flowing air from said tank, said conduit and said fitting being releasably secured to one another for supplying breathable air from said tank to the user of the mask, said fitting, said collar and said conduit being configured such that only one of said collar and said conduit is releasably secured to said fitting at any one time during use whereby air is supplied to the mask from the respiratory supply system or through said air filtration unit but not simultaneously from both said respiratory supply system and said air filtration unit.

14. A personal emergency breathing system for attachment to a gas mask, comprising:

a canister having an opening and a closure removably carried by said canister for closing said opening, said canister including an air passage in communication with said opening for receiving ambient air upon removal of said closure;

an air filtration unit containing air filtering material within said canister for filtering ambient air received through said opening, said air passage and said filtering material when said closure is removed;

a collar carried by said canister and defining a filtered air outlet passage in communication with said air filtration unit for receiving filtered air therefrom, said collar being adapted for releasable securement to a fitting on the gas mask for releasably securing the canister to the gas mask whereby filtered air may be transmitted from the canister through said collar and said filter air outlet passage into the gas mask;

a catch carried by said canister and pivotal between a first position enabling securement between said collar and the fitting and a second position, after release of the canister and gas mask, precluding resecurement of the collar and the fitting; and a movable member carried by said collar for retaining said pivoted catch in said second position.

15. A breathing system according to claim 14 wherein said collar includes threads for forming a threaded connection with the fitting of the gas mask, said catch having a threaded segment forming a portion of said threads on said collar in said first position of said catch, said threaded segment in said second position of said catch being located out of alignment with the threads of the collar.

16. A breathing system according to claim 14 wherein said movable member includes a ring on said collar having an axis and movable axially between a first retaining position maintaining said catch in said first position enabling securement between the collar and the fitting and a second retaining position maintaining said catch in said second position precluding resecurement of the canister and gas mask to one another.

17. A breathing system according to claim 14 wherein said collar includes threads for forming a threaded connection with the fitting of the gas mask, said catch having a threaded segment forming a portion of said threads on said collar in said first position of said catch, said threaded segment in said second position of said catch being located out of alignment with the threads of the collar, said movable member including a ring on said collar having an axis and movable axially between a first retaining position maintaining said catch in said first position thereof enabling securement between the collar and the fitting and a second retaining position maintaining said catch in said second position thereof precluding resecurement of the canister and gas mask to one another.

18. A breathing system according to claim 17 wherein said collar and said ring have mating detent surfaces in each of said first and second retaining positions of said collar.

19. A breathing system according to claim 14 in combination with said gas mask having said fitting, said collar including threads for forming a threaded connection with the fitting of the gas mask, said catch having a threaded segment forming a portion of said threads on said collar in said first position of said catch, said threaded segment in said second position of said catch being located out of alignment with the threads of the collar.

20. A method of supplying breathable air in a personal emergency breathing system including a gas mask for overlying a user's face, a respiratory air supply system having a tank of breathable air and normally coupled to said face mask for supplying breathable air thereto from said tank and a normally closed canister containing an air filtration unit for filtering ambient air, comprising the steps of:

disconnecting the respiratory air supply system from said face mask;

opening said normally closed canister to provide ambient air to said filtration unit;

receiving said canister to said gas mask for supplying ambient air through said filtration unit to said gas mask; and disconnecting the canister from the gas mask and preventing resecurement of said canister and said gas mask to one another.

21. A method according to claim 20 including disconnecting the canister from the face mask and indicating on said canister prior use of the canister.

* * * * *